US005465675A

United States Patent [19]

Pozzi et al.

[11] Patent Number: 5,465,675

[45] Date of Patent: Nov. 14, 1995

[54] OVEREDGE SEWING MACHINE INCLUDING AN UPPER LOOPER WITH A HOOKED MEMBER

[75] Inventors: Giuseppe Pozzi; Roberto Sanvito, both of Milan, Italy

[73] Assignee: Rimoldi Necchi, S.R.L., Milan, Italy

[21] Appl. No.: 281,751

[22] Filed: Jul. 28, 1994

[30] Foreign Application Priority Data

Oct. 27, 1993 [IT] Italy ..... MI93A2278

[51] Int. Cl.[6] ..... D05B 1/20; D05B 57/06

[52] U.S. Cl. ..... 112/162

[58] Field of Search ..... 112/34, 55, 162, 112/166, 168, 177, 200, 266.1, 269.1, 441

[56] References Cited

U.S. PATENT DOCUMENTS

| | | | |
|---|---|---|---|
| 585,939 | 7/1897 | Plumley | 112/269.1 X |
| 832,740 | 10/1906 | Maier | 112/269.1 X |
| 2,812,735 | 11/1957 | Nelson | 112/166 X |
| 3,079,879 | 3/1963 | Sigoda et al. | 112/166 X |
| 3,150,622 | 9/1964 | Sigoda | 112/168 X |
| 3,753,410 | 8/1973 | Kostenowczyk | 112/168 X |
| 4,580,514 | 4/1986 | Hanyu et al. | 112/166 X |
| 4,970,976 | 11/1990 | Kitai et al. | 112/162 |

*Primary Examiner*—C. D. Crowder
*Assistant Examiner*—Ismael Izaguirre
*Attorney, Agent, or Firm*—Laff, Whitesel, Conte & Saret, Ltd.

[57] ABSTRACT

In a trimming sewing machine of the type adapted to carry out a two-thread overedge stitch, provision is made for a hooked element (15) integrally associated with the upper looper (10), which hooked element has an end work portion (15*a*) disposed in parallel side by side relation with the end work portion (10*b*) of the upper looper. The hooked element (15) engages the sewing thread (3) carried by the needle (2) at the beginning of the downward stroke of the needle. Following the downward stroke of the upper looper (10), the hooked element (15) drags along the sewing thread (3) beyond the lateral edge (5*a*) of the workpiece (5). Thus paired finishing portions (17*a*, 17*b*) are formed along the sewing thread (3) and they extend from each of the insertion points of the needle (2) into the workpiece (5) as far as close to the lateral edge (5*a*) of the workpiece (5).

5 Claims, 3 Drawing Sheets

OVEREDGE SEWING MACHINE INCLUDING AN UPPER LOOPER WITH A HOOKED MEMBER

BACKGROUND OF THE INVENTION

1. Field of the Invention

The present invention relates to an apparatus for executing overedge stitch seams in trimming sewing machines, of the type comprising: at least one needle carrying a respective sewing thread and reciprocated with a rectilinear motion through a workpiece moving according to a given sewing direction; a lower looper carrying a respective interlacing thread, which looper operates under the workpiece and performs a reciprocating motion in a direction transverse to the sewing direction so that it cyclically engages through a loop formed by the sewing thread inserted through the workpiece; an upper looper reciprocated according to a curved trajectory extending on either side of the lateral edge of the workpiece, to engage the interlacing thread and arrange it over the workpiece so that it is interlooped by the sewing needle moving towards the workpiece.

It is also an object of the present invention to provide a method put into effect by said apparatus, said method comprising the steps of: inserting a sewing thread folded over into two side by side portions, through the workpiece; engaging an interlacing thread folded over into two consecutive and side by side portions, in a loop defined by the portions of the sewing thread inserted through the workpiece; carrying one of the interlacing thread portions astride a lateral edge of the workpiece; interlooping the sewing thread into the space defined between the interlacing thread portion over the workpiece and the workpiece edge, simultaneously with a new insertion step of the sewing thread through the workpiece.

It is a further object of the present invention provides a new seam formed by the apparatus and method in question, said seam being of the type comprising: at least one sewing thread engaged through a workpiece according to insertion points aligned in a sewing direction parallel to a lateral edge of the workpiece itself; an interlacing thread interlooped with the sewing thread.

2. Prior Art

It is known that in the field of making garments or the like, the sewing operations for assembling the different garment parts and/or for achieving an aesthetic finish of the edges of the obtained article are often carried out with the aid of trimming sewing machines adapted to execute an overedge stitch seam along the edges of the mutually superposed workpieces that are automatically trimmed while the seam is being made.

For the formation of an overedge stitch seam one or more threads are required. More particularly, provision is made for at least one sewing thread associated with a needle driven with a reciprocating motion, generally in a vertical plane, through the workpiece that, by feed means operating in synchronism with other component parts of the sewing machine, is moved forward along a needle plate according to a given sewing direction. Upon the action of the needle, the sewing thread is inserted through the fabric and, when the needle starts its upward stroke, it forms a loop inside which an interlacing thread is normally inserted, which thread is engaged with the end of a lower looper located under the needle plate and provided with a reciprocating motion in a direction transverse to the sewing direction.

When the lower looper, and therefore the interlacing thread, have been conveniently engaged into the loop formed by the sewing thread, the interlacing thread is engaged by an upper looper provided with a reciprocating motion according to a trajectory extending on either side of the lateral edge of the workpiece. More particularly, the upper looper engages the interlacing thread so as to drag it along over the workpiece and prepare it for being interlooped by the needle and subsequently the sewing thread, when a new downward stroke is performed by the needle, following which the sewing thread will be inserted again through the workpiece in order to give rise to the formation of a new sewing stitch.

In a seam thus executed, the sewing thread is disposed on the "right side" of the workpiece, that is on that part which can be seen by an operator while the seam is being made, according to a plurality of rectilinear short lengths or portions parallel to the lateral edge of the workpiece, joined one after the other at the points where the needle has entered the workpiece. The interlacing thread, on the workpiece, is disposed so as to form a series of short lengths extending according to an oblique alternate course between each of the points where the needle insertion has occurred and the lateral edge of the workpiece. On the reverse side of the workpiece, that is the side facing the needle plate while a seam is being formed, the sewing thread is disposed so as to form, in the same manner as previously said with reference of the interlacing thread on the right side of the workpiece, a plurality of short lengths following each other according to an oblique alternate course between the insertion points of the needle an the lateral edge of the workpiece where the same portions of the sewing thread are engaged with the interlacing thread.

The overedge stitch seam of the above type listed under Nos. 502 and 503 in the Federal Standard Catalogue, as well as other types of overedge stitch seams, are sometimes also utilized as an ornamental finish along the edges of garments or the like.

The foregoing being stated, it is to be noted that in recent times there has been a great demand on the market for garments finished along their edges by seams executed with a particular type of stitch which in the art is usually referred to as "saddle stitch".

Presently these seams are executed by sewing machines comprising a needle carrying a sewing thread and reciprocated through the workpiece. Cooperating with the needle is a particular looper exhibiting a configuration similar to that of a common knitting machine needle provided with a closure latch, reciprocated according to a U-shaped trajectory extending astride the workpiece edge. Such a looper at each lowering step of the reciprocating movement, picks up the sewing thread and disposes it so that it can be interlooped by the needle under the workpiece and, at each raising step, picks up the sewing thread carried by the needle under the workpiece and moves it into readiness for being interlooped by the needle during the new downward stroke of the latter.

In conclusion there is the formation of a sewing chain with a single thread which lays on the right side of the workpiece according to a plurality of short lengths oriented perpendicularly to the lateral edge. On the reverse side of the workpiece, the sewing thread forms a plurality of consecutive short lengths disposed obliquely with an alternate course in the space existing between the points of the needle insertion and the lateral edge of the workpiece.

While finishing seams of the above type have been greatly appreciated on the market, it is pointed out that garment manufacturers encounter many problems in this type of working, first of all because it is necessary to set up a sewing machine expressly produced for the execution of said seams and in addition because said seams are used only on a limited typology of articles of clothing and consequently they could be no longer utilized should these articles be no longer required.

It is also to be noted that due to the structural conception of the looper and the particular movements it must perform, there are many restrictions in the operating speed of the sewing machines adapted to execute seams of the above specified type.

SUMMARY OF THE INVENTION

Under this situation, the present invention substantially aims to eliminate the problems of the known art by providing a method and an apparatus enabling the execution of seams having the aesthetic features typical of seams obtained through the so-called "saddle stitch", without on the other hand resorting to the use of special sewing machines set up expressly.

Now it has been surprisingly found that, in accordance with the present invention, conventional trimming sewing machines designed to execute a two-thread overedge stitch can be set up for modifying the execution of the normal overedge stitch so as to obtain, in an unexpected manner, a seam having aesthetic and ornamental features quire identical with those of the "saddle stitch" seams.

In greater detail, the invention relates to an apparatus for carrying out overedge stitch seams on trimming sewing machines, said apparatus further comprising at least one hooked element rigidly carried by the upper looper and designed to engage the sewing thread at a portion thereof extending from the workpiece to the needle, in order to drag along said sewing thread beyond the lateral edge of the workpiece during the movement carried out by the upper looper away from the needle.

In accordance with the invention, such an apparatus puts into practice a method of executing overedge stitch seams on trimming sewing machines, wherein after the interlooping step and simultaneously with the new step of inserting the sewing thread, the step of dragging along, beyond the lateral edge of the workpiece, the sewing thread portion extending from the workpiece to the needle is carried out, so that said sewing thread portion arranges itself according to two paired finishing portions, oriented transversely to the lateral edge of the workpiece.

Still in accordance with the present invention the method and apparatus in question lead to the formation of a seam, wherein the sewing thread extends, at each of said insertion points into the workpiece, according to two mutually paired finishing portions continuing transversely to the sewing direction as far as close to the lateral edge of the workpiece, where the sewing thread is interlooped by the interlacing thread.

BRIEF DESCRIPTION OF THE DRAWINGS

Further features and advantages will become more apparent from the detailed description of a preferred embodiment of an apparatus and method for executing overedge stitch seams on trimming sewing machines, as well as the seam thus obtained, according to the present invention. This description will be given hereinafter, by way of non-limiting example, with reference of the accompanying drawings, in which.

DESCRIPTION OF THE PREFERRED EMBODIMENT

Figure 1:
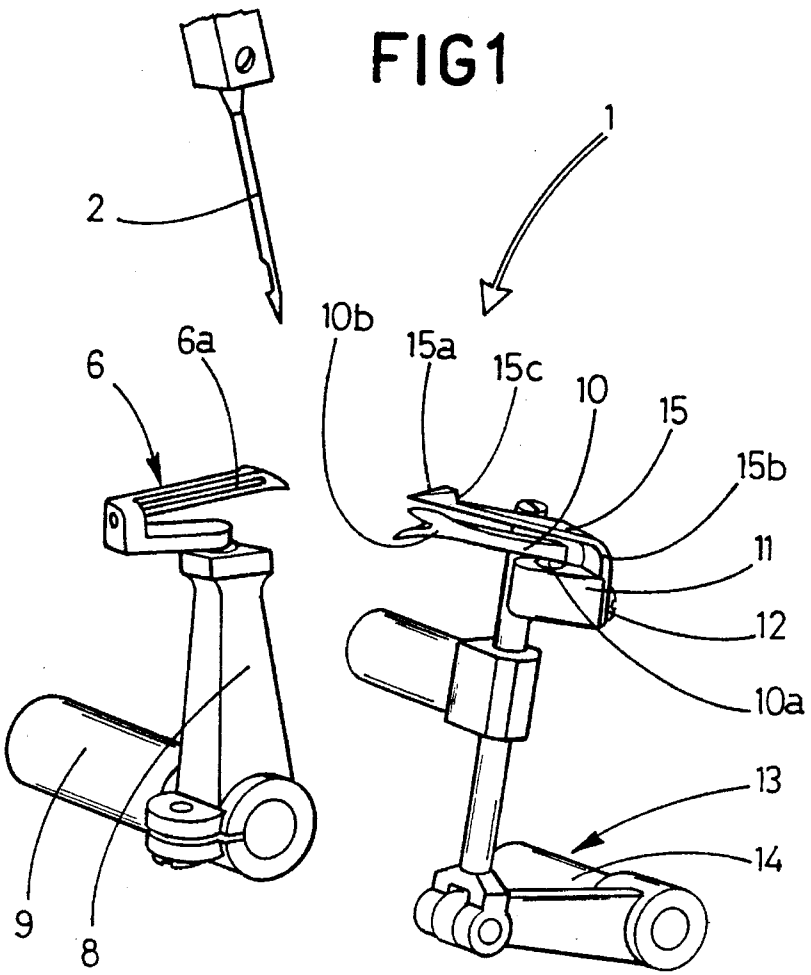
FIG. 1 is a perspective view of the main cooperating component parts of the apparatus in reference, designed to form a seam.

With reference to the drawings, an apparatus for executing overedge stitch seams on trimming sewing machines according to the present invention has been generally identified by reference numeral 1.

In the accompanying drawings, the only members cooperating in forming a seam have been shown, since all the other component parts are known per se and conventional.

Figure 3:
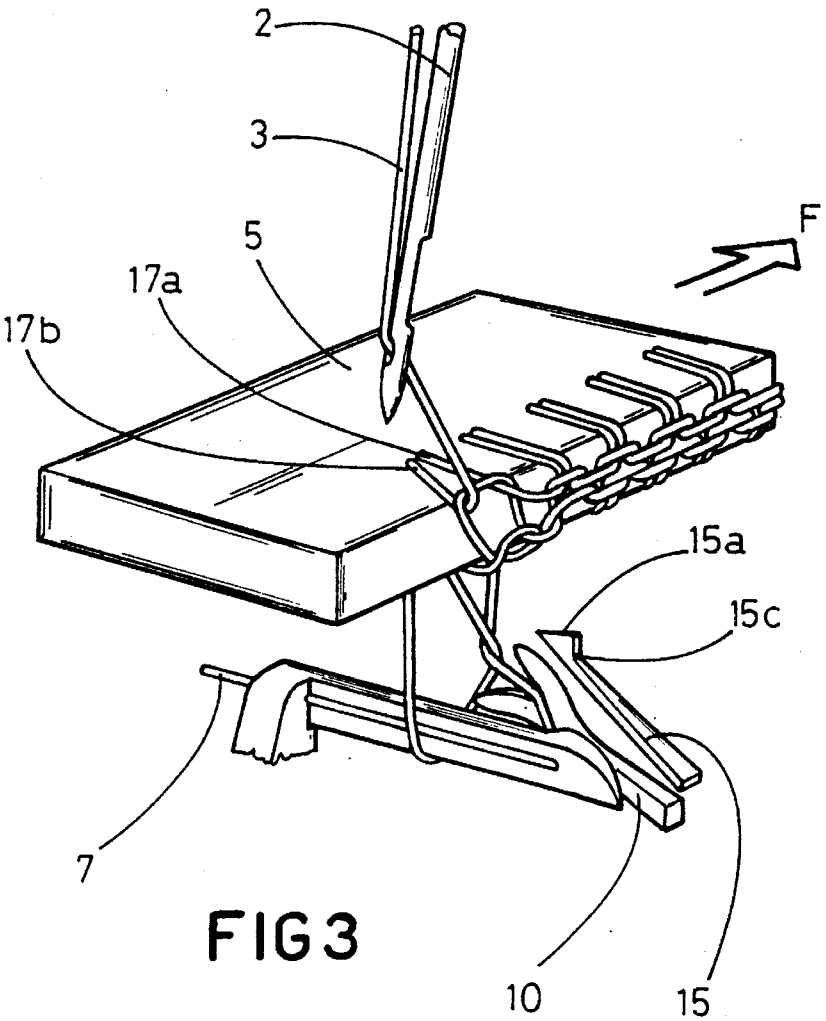
FIG. 3 shows the step subsequent to that shown in FIG. 2, wherein the interlacing thread carried by the lower looper is engaged by the upper looper.

The apparatus 1 comprises at least one needle 2 carrying a respective sewing thread 3 and operable with a reciprocating rectinlinear movement through a workpiece 5 that, in synchronism with the needle 2 movements, is moved horizontally on a needle plate, not shown as known per se and conventional, according to a given sewing direction denoted by arrow "F" in FIG. 3.

Still in a manner known per se, a lower looper 6 cooperates with the needle 2; said looper is placed under said needle plate and the workpiece 5 and caries a corresponding interlacing thread 7. The lower looper 6, mounted to a support arm 8, in turn fastened to a first drive shaft 9 swinging about its own axis, is reciprocated according to a direction substantially perpendicular to the sewing direction "F".

The apparatus 1 further comprises an upper looper 10 exhibiting a positioning shank **10*a* fitted in a block 11 and fastened thereto by a clamping screw 12. By a drive lever system 13 carrying the support block 11 and operable through a second drive shaft 14 swinging about its own axis, the upper looper 10 is reciprocated so that one end work portion 10*b* thereof describes a curved trajectory extending astride a lateral edge 5*a* of the workpiece 5**.

According to the present invention, the apparatus 1 further comprises at least one hooked element 15 rigidly engaged with respect to the upper looper 10 and has an end work portion **15*a* located in parallel side by side relation with respect to the work portion 10*b*** of the looper itself.

Preferentially, the hooked element 15 is made integral with the upper looper 10 by the selfsame clamping screw 12 used to achieve a stable positioning of the upper looper.

In the connection, the hooked element 15 exhibits, on the opposite side from the end work portion 15*a*, a connecting tang 15*b* passed through by the clamping screw 12 and interposed between the support block 11 and the clamping screw head.

As can be easily understood from the accompanying drawings, the end work portion 15*a* of the hooked element 15 preferably has a sharpened plate-like configuration lying in a substantially vertical plane and provided, at the upper part thereof, with a holding shoulder 15*c* facing away from the apex of the end portion itself.

In accordance with a sewing method being the object of the present invention too, operation of the apparatus 1 described above mainly as regards structure, is as follows.

Each time the needle 2 performs a lowering step of its reciprocating motion, the sewing thread 3, folded over so as to form two side by side portions at the needle's eye 2*a*, is inserted through the workpiece 5, at an insertion point 4 placed to a given distance from the lateral edge 5*a* of the workpiece itself.

Figure 2:
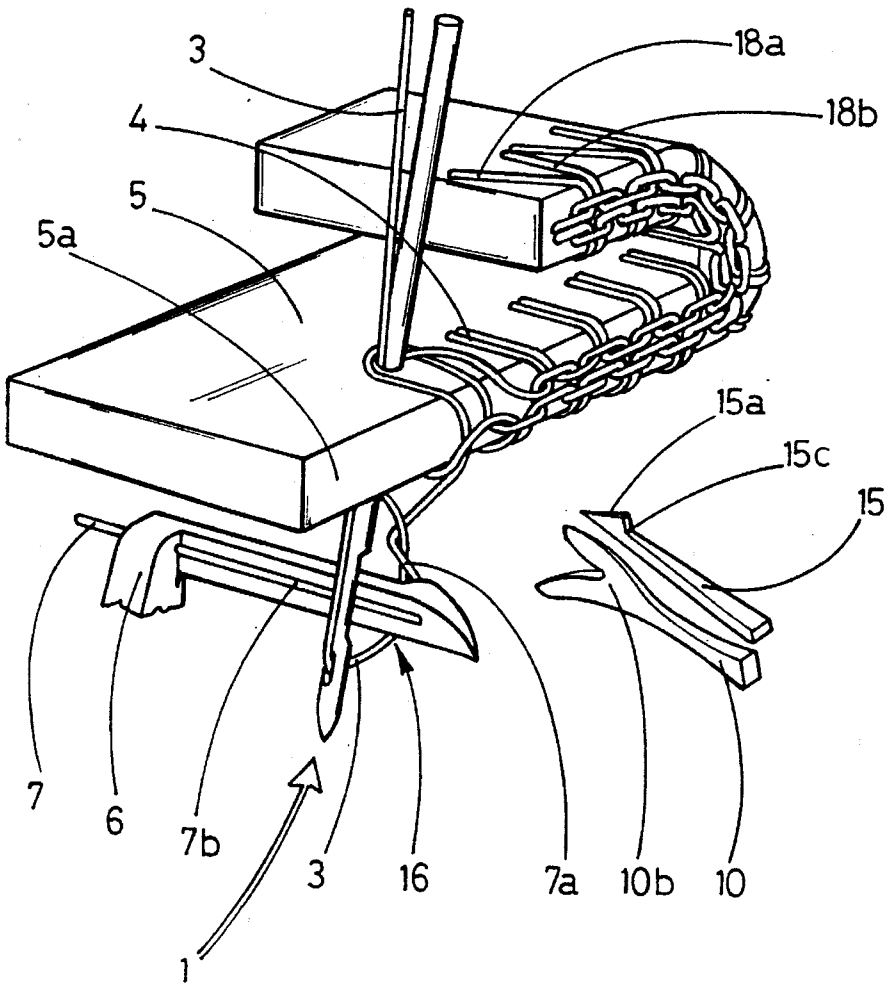
FIG. 2 is a diagrammatic perspective view of an operating step during which the sewing thread, previously introduced through the workpiece by the needle, is engaged by the interlacing thread carried by the lower looper.

When the needle 2 has come to the end of its downward stroke and begins its raising step, the sewing thread 3 forms a loop 16 into which the lower looper 6 carrying out the going movement of its reciprocating motion is inserted, as shown in FIGS. 2 and 3. During this step the interlacing thread 7, disposed so as to form two consecutively folded over portions 7*a*, 7*b* at a through hole 6*a* arranged on the looper 6 end, is engaged in the loop 16 defined by the sewing thread 3.

As shown in FIG. 3, when the lower looper 6 comes close to the end of the going stroke of its reciprocating motion, the upper looper 10, on performing the raising step of its movement, slightly touches the lower looper by its end work portion 10*b*, so as to engage one of the interlacing thread portions 7*a*, 7*b*, on said selfsame end work portion. More particularly, the upper looper 10 engages the interlacing thread portion 7*a* previously engaged to the workpiece 5 when the previous sewing stitch was being formed.

Figure 4:
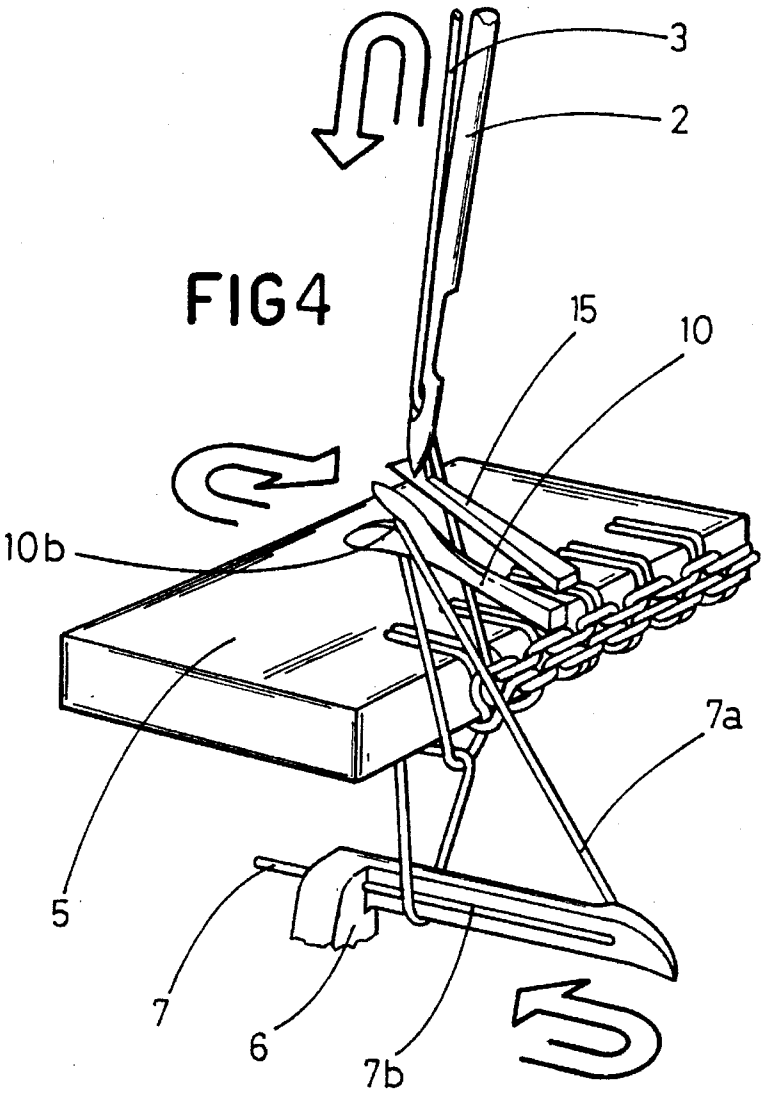
FIG. 4 shows an operating step subsequent to the one shown in FIG. 3, wherein the upper looper carries the interlacing thread above the workpiece so that it may be interlooped by the sewing needle.

As shown in FIG. 4, following the completion of the upward stroke of the upper looper 10, the interlacing thread portion 7*a* is moved astride the lateral edge 5*a* of the workpiece and such arranged, over the workpiece itself, that it can be interlooped by the sewing needle 2 which meanwhile has completed its upward stoke and is about to begin a new downward stroke of its reciprocating motion.

Advantageously, according to the present invention, when the upper looper has reached the end of its upward stroke, the hooked element 15 is placed, by its end portion 15*a*, under a portion of the sewing thread 3 that extends from the workpiece 5 to the needle's eye 2*a*, as clearly shown in FIG. 4. Under this situation, the end work portions 10*b* and 15*a* of the upper looper 10 and hooked element 15 are disposed at parallel side by side locations under the needle 2 tip, before and behind the movement trajectory of the needle respectively, with reference to the feed direction "F" of the workpiece 5.

Under this situation the needle 2, on carrying out its new downward stroke towards the workpiece 5, will be subjected to enter an ideal triangle defined between the upper looper 10, the portion 7*a* of the interlacing thread 7 held thereby, and the lateral edge 5*a* of the workpiece 5, so as to interloop the sewing thread 3 with the interlacing thread itself.

Figure 5:
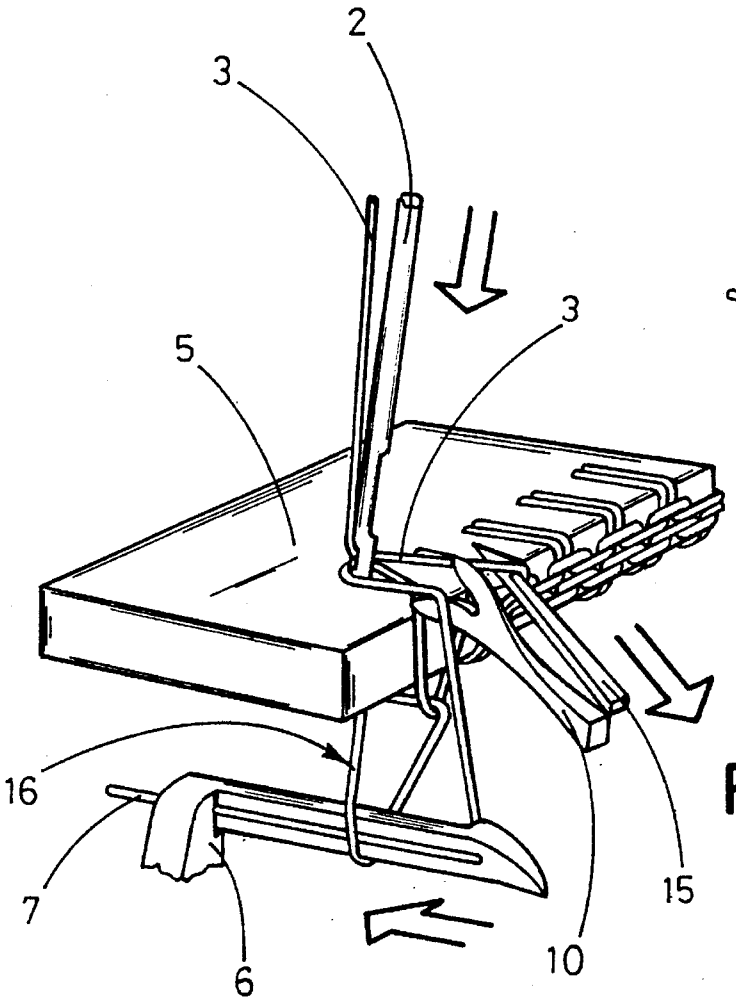
FIG. 5 shows an operating step subsequent to the one shown in FIG. 4, wherein, simultaneously with the downward stroke of the upper looper, a hooked element carried by said upper looper carries out transportation of the sewing thread beyond the lateral edge of the workpiece.

Simultaneously, the sewing thread 3 is engaged astride the hooked element 15, so that it can be retained by the holding shoulder 15*c* when the upper looper 10, and therefore the hooked element itself, perform the lowering step of their reciprocating motion. During this step, as shown in FIG. 5, the sewing thread will be dragged along beyond the lateral edge 5*a* of the workpiece 5, before the end work portion 15*a* of the hooked element 15 will leave it, when the curved movement trajectory travelled over by the upper looper 10, and therefore the hooked element itself, takes a substantially vertical direction.

Figure 6:
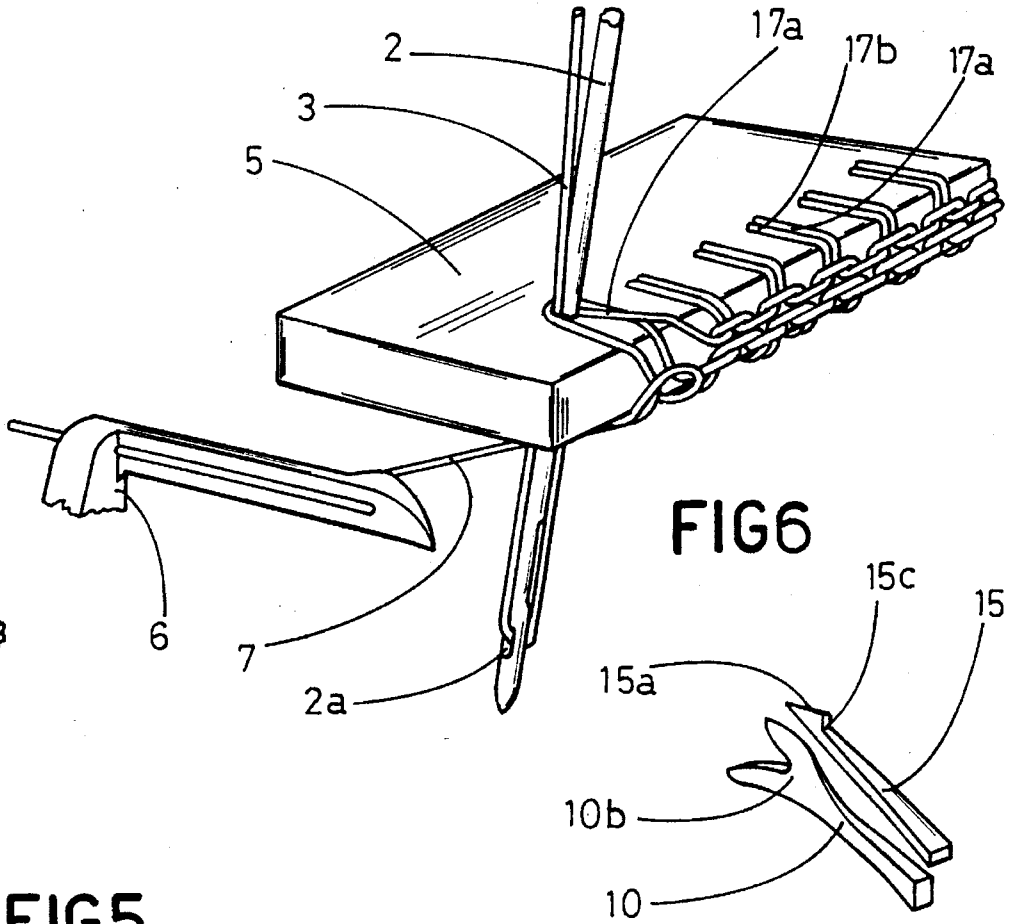
FIG. 6 shows an operating step subsequent to the one shown in FIG. 5, wherein the needle passes through the workpiece again.

Thus a first finishing portion 17*a* is defined along the sewing thread on the right side of the workpiece 5, that is the side that an operator can see while the seam is being made, said portion extending beyond the free edge 5*a* of the workpiece, as shown in FIG. 6. This finishing portion 17*a* will be substantially disengaged from the edge 5*a* of the workpiece 5 during the following steps involving insertion of the needle 2 through the workpiece and engagement of the lower looper 6 in the loop 16 defined by the sewing thread 3.

After the needle 2, as viewed from FIG. 3, has emerged again from the workpiece 5 and the lower looper 6 has completed its going stroke, the interlacing thread 7, now interlooped with the sewing thread 3 from the needle 2, will form with the sewing thread itself a second finishing portion 17*b* that will be paired with the first finishing portion 17*a* and, together with said first finishing portion, will be anchored to the lateral edge 5*a* of the workpiece 5, where the interlacing thread takes a substantially waving course, as clearly shown in the accompanying drawings.

Thus a seam is achieved in which, at each of the insertion points 4 of the needle 2 in the workpiece 5, the sewing thread 3 on the right side of the workpiece extends according to two mutually paired finishing portions 17*a*, 17*b* extending transversely to the sewing direction "F" as far as close to the lateral edge 5*a* of the workpiece, where the sewing thread 3 is interlooped by the interlacing thread 7.

By suitably synchronizing the advancing of the workpiece 5 with the movement of the needle 2 and the lower and upper loopers 6 and 10, it is possible to make the paired finishing portions 17*a*, 17*b* take an oblique orientation or, alternatively, according to requirements, an orientation substantially perpendicular to the lateral edge 5*a* of the workpiece 5.

On the workpiece 5 side opposite to the finishing portions 17*a*, 17*b*, the sewing thread 3 extends according to oblique portions 18*a*, 18*b* following each other with an alternate sequence substantially in the same manner as in overedge stitch seams performed according to the known art.

The present invention attains the intended purposes.

In fact it is pointed out that the presence of the paired finishing portions 17*a*, 17*b* on the right side of the workpiece gives the overedge stitch seam performed according to the present invention an appearance quite similar to that of seams formed with the so-called "saddle stitch".

Therefore, by merely modifying an overlock sewing machine of the universal type as used in the clothing manufacturing industry, the invention offers the possibility of meeting those aesthetic finishing requirements which have been hitherto dependent on the purchase and maintenance of a special sewing machine to be used only and exclusively for executing finishing seams of the type in question.

The invention therefore, in addition to the economic advantage resulting from the fact that it is no longer necessary to buy a special sewing machine, also offers the possibility of restoring the normal operation of a trimming overlock sewing machine by merely removing the hooked element 15 when no more articles of clothing finished with a saddle stitch seam are to be produced.

It is also to be pointed out that the execution of a seam with a sewing machine according to the present invention can take place at a speed which is about twice that of the known art machines.

It is understood that modifications and variations may be made to the sewing machine as conceived without departing from the scope of the invention as characterized by the appended claims.

What is claimed is:

1. An apparatus for executing overedge stitch seams in trimming sewing machines, comprising:

at least one needle (2) carrying a respective sewing thread (3) and reciprocated with a rectilinear motion through a workpiece (5) moving according to a given sewing direction ("F");

a lower looper (6) carrying a respective interlacing thread (7), which looper operates under the workpiece (5) and performs a reciprocating motion in a direction transverse to the sewing direction ("F") so that said lower looper cyclically engages through a loop (16) formed by the sewing thread (3) inserted through the workpiece (5);

an upper looper (10) reciprocated according to a curved trajectory extending on either side of a lateral edge (5*a*) of the workpiece (5), to engage the interlacing thread (7) and arrange the lateral edge over the workpiece (5) so that said interlacing thread is interlooped by the sewing needle (2) moving towards said workpiece, said apparatus further comprises at least one hooked element (15) rigidly carried by the upper looper (10) to engage the sewing thread (3) at a portion thereof extending from the workpiece (5) to the needle (2), in order to drag along said sewing thread beyond said lateral edge (5*a*) of the workpiece (5) during the movement carried out by the upper looper (10) away from the needle (2).

2. The apparatus as claimed in claim 1, wherein said hooked element (15) has an end pointed work portion (15*a*), said upper looper (10) has a free end work portion (10*b*), said end pointed work portion (15*a*) being disposed in parallel side by side relation with said free end work portion (15*a*) being disposed in parallel side by side relation with said free end work portion (10*b*).

3. The apparatus as claimed in claim 1, wherein said hooked element (15) has an end work portion (15*a*) having a sharpened plate-like configuration, lying in a substantially vertical plane, said hooked element (15) having an upper part, said upper part having a holding shoulder (15*c*) facing away from an apex of the end work portion.

4. The apparatus as claimed in claim 1, wherein said hooked element (15) is fastened to a support block (11) carrying the upper looper (10).

5. The apparatus as claimed in claim 4, wherein said hooked element (15) has a connecting tang (15*b*) operatively interposed between said support block (11) and a head of a clamping screw for locking the upper looper (10).

* * * * *